US006956014B2

(12) United States Patent
Kubo et al.

(10) Patent No.: US 6,956,014 B2
(45) Date of Patent: Oct. 18, 2005

(54) THICKENER

(75) Inventors: Makoto Kubo, Wakayama (JP); Yohei Kaneko, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/694,820

(22) Filed: Oct. 29, 2003

(65) Prior Publication Data

US 2004/0142849 A1 Jul. 22, 2004

(30) Foreign Application Priority Data

Nov. 8, 2002 (JP) ..... 2002-324777

(51) Int. Cl.[7] ..... C11D 1/66; C11D 3/32; C11D 1/72

(52) U.S. Cl. ..... 510/126; 510/130; 510/137; 510/138; 510/502; 510/506; 564/192; 564/204; 564/215

(58) Field of Search ..... 510/126, 130, 510/137, 138, 502, 506; 564/192, 204, 215

(56) References Cited

U.S. PATENT DOCUMENTS

| | | | | |
|---|---|---|---|---|
| 2,927,081 | A | 5/1960 | Schramm | |
| 5,688,978 | A | 11/1997 | Lefebvre et al. | |
| 6,172,035 | B1 * | 1/2001 | Hohn-Stocker et al. | 510/501 |
| 6,514,918 | B1 * | 2/2003 | Librizzi | 510/124 |

FOREIGN PATENT DOCUMENTS

| | | | |
|---|---|---|---|
| DE | 198 27 304 | | 2/1999 |
| EP | 232153 | * | 8/1987 |
| EP | 1 033 363 | | 9/2000 |
| JP | 2001-131132 | | 5/2001 |
| WO | WO 97/03646 | | 2/1997 |
| WO | WO 99/46356 | * | 9/1999 |
| WO | WO 03/040253 | | 5/2003 |

* cited by examiner

*Primary Examiner*—Gregory R. Del Cotto
(74) *Attorney, Agent, or Firm*—Oblon, Spivak, McClelland, Maier & Neustadt, P.C.

(57) ABSTRACT

A thickener which is superior in handling characteristics and blending stability and has a high thickening action is provided, comprising a fatty acid alkanolamide represented by the general formula (1) and a surfactant composition comprising the thickener and at least one surfactant:

(1)

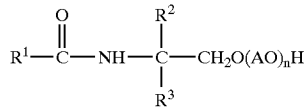

wherein $R^1$ represents a straight-chain or branched alkyl or alkenyl group having 5 to 21 carbon atoms which may be substituted with at least one hydroxy group, $R^2$ and $R^3$ independently represent an alkyl group having 1 to 2 carbon atoms, AO represents an oxyalkylene group having 2 to 4 carbon atoms and n denotes a number of 0 to 10 in average.

13 Claims, No Drawings

THICKENER

TECHNICAL FIELD OF THE INVENTION

The present invention relates to a thickener and also a surfactant composition containing the thickener.

PRIOR ARTS

Detergents are improved in handling characteristics by imparting a proper viscosity corresponding to each use or each system of these detergents is increased in viscosity as required to maintain the dispersibility of water-insoluble materials to be formulated.

Generally, alkanolamide type surfactants, betaine type surfactants and semi-polar type surfactants (e.g., alkyldimethylamine oxides) are known as thickeners and used in many detergent applications at present.

Alkanolamide type surfactants are classified into a monoalkanolamide type and a dialkanolamide type. The monoalkanolamide type is superior in thickening action but is not regarded as thickeners having good handling characteristics because it has a high melting point. On the other hand, the dialkanolamide type has high blending stability but is not always regarded as bases having excellent thickening characteristics.

Also, though a trimethylol type compound is disclosed in U.S. Pat. No. 2,927,081 and a dialkanol type compound is disclosed in JP-A 2001-131132. However, the trimethylol type has high crystallinity and therefore there is a difficulty in handling characteristics and low-temperature stability. Also, the dialkanol type is not always regarded as a base having excellent thickening characteristics.

In view of this situation, thickeners which are superior in handling characteristics and blending stability, have high thickening characteristics and foam-increasing effect and are preferably used as detergent compositions and the like have been desired.

SUMMARY OF THE INVENTION

It is a purpose of the present invention to provide a thickener which is superior in handling characteristics and blending stability and has a high thickening action and to provide a surfactant composition containing the thickener.

The present inventors have found that a specific fatty acid alkanolamide type compound has a low melting point and is a liquid at normal temperature and therefore superior in handling characteristics, has high thickening action, exhibiting high thickening action when it is added to various surfactants.

Accordingly, the present invention provides a thickener comprising a fatty acid alkanolamide (hereinafter, referred to as compound (1)) represented by the general formula (1):

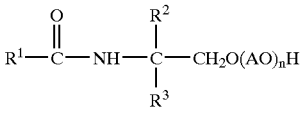

(1)

wherein $R^1$ represents a straight-chain or branched alkyl or alkenyl group having 5 to 21 carbon atoms which may be substituted with at least one hydroxyl group, $R^2$ and $R^3$ independently represent an alkyl group having 1 to 2 carbon atoms, AO represents an oxyalkylene group having 2 to 4 carbon atoms and n denotes a number of 0 to 10 in average.

The invention then provides a surfactant composition comprising the thickener and at least one surfactant.

The invention then provides use of a fatty acid alkanolamide as defined above to thicken a surfactant and a method of thickening a surfactant, which comprises mixing a fatty acid alkanolamide as defined above with the surfactant.

MORE DETAILED EXPLANATION OF THE INVENTION

In the compound (1), $R^1$ represents a straight-chain or branched alkyl or alkenyl group having 5 to 21 carbon atoms which may be substituted with at least one hydroxyl group and is preferably those having 7 to 17 carbon atoms. Specific examples of $R^1$ include residues obtained by excluding a carboxyl group from fatty acids such as caprylic acid, capric acid, lauric acid, myristic acid, palmitic acid, stearic acid, oleic acid, ricinoleic acid, 12-hydroxystearic acid and isostearic acid.

$R^2$ and $R^3$ independently represent an alkyl group having 1 to 2 carbon atoms. The compound (1) in which $R^2$ and $R^3$ are both methyl groups are preferable. AO represents an oxyalkylene group having 2 to 4 carbon atoms and is preferably an oxyethylene group. n denotes a number of 0 to 10 which shows the average addition mol number of alkylene oxides and is preferably 0 to 5.

The compound (1) may be produced by reacting a higher fatty acid represented by the general formula (2):

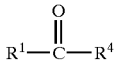

(2)

wherein $R^1$ has the same meaning as above, $R^4$ represents a hydroxyl group, an alkoxy group having 1 to 3 carbon atoms, a group represented by the formula —$CH_2CH(OY)$—$CH_2(OZ)$ (where Y and Z independently represent a hydrogen atom or a straight-chain or branched acyl group having 6 to 22 carbon atoms which may be substituted with at least one hydroxyl group) or a halogen atom; or its derivatives (hereinafter, referred to as fatty acid component (2)) with an alkanolamine represented by the general formula (3):

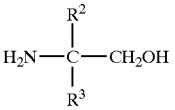

(3)

wherein $R^2$ and $R^3$ have the same meanings as above: and by further adding an alkylene oxide having 2 to 4 carbon atoms according to the need.

Examples of the fatty acid component (2) to be used for the production of the compound (1) include fatty acids such as caprylic acid, capric acid, lauric acid, myristic acid, palmitic acid, stearic acid, oleic acid, ricinoleic acid, 12-hydroxystearic acid and isostearic acid; lower alkyl esters of these fatty acids, for example, methyl esters and ethyl esters; glycerides of these fatty acids, for example, natural oil and fats such as coconut oil, palm oil and palm kernel oil and mixtures of these natural oil and fats; and halides of these fatty acids such as chlorides and bromides. Among these fatty acid components (2), fatty acids, fatty acid lower alkyl esters and fatty acid glycerides are particularly preferable because these compounds are not accompanied by the generation of inorganic salts.

Examples of the amine (3) include 2-amino-2-methyl-1-propanol and 2-amino-2-ethyl-1-butanol. 2-amino-2-methyl-1-propanol is preferable.

In the production of the compound (1), the reaction between the fatty acid component (2) and the amine (3) may be run in a generally known reaction condition and proceeds in the presence of a catalyst using an alcoholate or also in the presence of no catalyst. For example, when a fatty acid lower alkyl ester such as fatty acid methyl ester or a fatty acid glyceride such as coconut oil or palm kernel oil is used as the fatty acid component (2), the reaction temperature between the fatty acid component (2) and the amine (3) proceeds at temperatures ranging from 50 to 130° C. in the case of using sodium methylate as a catalyst and at temperatures ranging from 130 to 220° C. in the case of using no catalyst. Also, in the case of using a fatty acid as the fatty acid component (2), the reaction between the fatty acid component (2) and the amine (3) proceeds at a reaction temperature of 120 to 220° C. When the reaction temperature is high, there is the case where the intermolecular dehydration of the product takes place to form oxazoline. In this case, it is necessary to run hydrolysis by adding water.

Also, when a fatty acid halide is used as the fatty acid component (2), the reaction with the amine (3) can also be run by a known method. For example, as to the reaction between a fatty acid chloride and the amine (3), the amine (3) is charged in an aqueous solution system in the presence of an organic solvent or in an aqueous solution system and a reaction is allowed to proceed at a reaction temperature of −20 to 50° C. with adding dropwise a fatty acid chloride and an alkali simultaneously by controlling the system pH to 7 to 12. Examples of the organic solvent in this case include acetone, isopropyl alcohol, diethyl ether, etc. Also, given as examples of the alkali are sodium hydroxide, potassium hydroxide, sodium carbonate, sodium bicarbonate, etc.

The molar ratio ((2):(3)) of the amine (3) to fatty acid component (2) to be charged is preferably in the range of 1:1 to 1:1.3 and more preferably in the range of 1:1 to 1:1.1, specially preferably 1:1 to 1:1.01, when the fatty acid component (2) is other than oil and fats in view of reactivity and economical aspect. Also, when the fatty acid component (2) is oil and fats, the molar ratio ((2):(3)) is preferably in the range of 1:3.0 to 1:3.9 and more preferably in the range of 1:3.0 to 1:3.3.

To the reaction product obtained by the reaction of the fatty acid component (2) with the amine (3) is further added an alkylene oxide having 2 to 4 carbon atoms according to the need. An addition reaction of an alkylene oxide may be run using a known method. For example, the alkylene oxide is reacted at 80 to 200° C. and preferably 80 to 130° C. with charging it continuously or intermittently or in a batch system in a pressure closed container, whereby an alkylene oxide adduct can be produced with ease.

The compound (1) obtained after the reaction is finished may contain unreacted products and byproducts in such an amount as to give no hindrance to actual use.

The compound (1) of the present invention allows the viscosity of a blended composition to be increased by compounding a surfactant and is therefore useful as a thickener for such a composition, and also has the effect of improving foaming characteristics.

Examples of the surfactant include anionic surfactants, amphoteric surfactants, cationic surfactants, nonionic surfactants and semi-polar surfactants (e.g., alkyldimethylamine oxides). Particularly, the compound (1) has a significant thickening action in an anionic surfactant system.

Examples of the anionic surfactant used in the present invention include alkyl sulfates, polyoxyethylenealkyl ether sulfates, alkylbenzene sulfonates, alkyl fatty acid salts, alkyl phosphates, acylated amino acid salts, alkylamide ether sulfates, etc. As the alkyl groups of these anionic surfactants, those having 5 to 30 and particularly 8 to 18 carbon atoms are preferable. As the acyl group, those having 6 to 31 and particularly 7 to 17 carbon atoms are preferable. Also, examples of the salts include alkali metal salts, ammonium salts, alkyl or alkenylamine salts having a total carbon number of 1 to 22, alkanolamine salts having a total carbon number of 1 to 22, basic amino acid salts, etc. Alkali metal salts are preferable and sodium salts and potassium salts are particularly preferable.

In the surfactant composition containing the compound (1) and a surfactant according to the present invention, the content of the compound (1) is preferably 0.1 to 50% by weight and more preferably 0.5 to 20% by weight. The content of the surfactant is preferably 0.5 to 90% by weight and more preferably 1 to 50% by weight.

The compound (1) of the present invention may be compounded in detergents and cosmetics in, for example, household or personal care applications. The proportion of the compound (1) when compounded in these detergents and cosmetics is preferably 0.1 to 50% by weight and particularly preferably 0.5 to 20% by weight in these detergents or cosmetics though no particular limitation is imposed on it. Also, a two-component system consisting of the compound (1) and a surfactant may be adopted or the compound (1) may be added to a combination of various surfactants without any problem.

The thickener of the present invention has a low melting point and is therefore a liquid at normal temperature, exhibiting excellent handling characteristics and blending stability. Also, it has high thickening action and can therefore impart high thickening ability when it is blended in various surfactants.

EXAMPLE

Synthetic Example 1

A 1 l reactor equipped with a temperature gage, a stirrer, a nitrogen introducing pipe and a reflux condenser was charged with 214 g (MW: 214, 1 mol) of methyl laurate and 91 g (MW: 89.1, 1.02 mol) of 2-amino-2-methyl-1-propanol. The mixture was raised up to 85° C. with blowing nitrogen into the reactor and then 5 g of 28% sodium methylate was added thereto. Then, the mixture was kept for 3 hours. Upon completion of the reaction, gas chromatography was used to confirm that the methyl laurate left was less than 1%, to carry out cooling.

Synthetic Example 2

The same reactor that was used in Synthetic Example 1 was charged with 217 g (MW: 657.5, 0.33 mol) of coconut oil and 90 g (1.01 mol) of 2-amino-2-methyl-1-propanol. The mixture was raised up to 85° C. with blowing nitrogen into the reactor and then 5 g of 28% sodium methylate was added thereto. Then, the mixture was kept for 3 hours. Upon completion of the reaction, gas chromatography was used to confirm that the coconut oil left was less than 1%, to carry out cooling.

Synthetic Example 3

The same reactor that was used in Synthetic Example 1 was charged with 226.4 g (MW: 686.0, 0.33 mol) of palm kernel oil and 90 g (1.01 mol) of 2-amino-2-methyl-1-propanol. The mixture was raised up to 85° C. with blowing nitrogen into the reactor and then 5 g of 28% sodium methylate was added thereto. Then, the mixture was kept for 3 hours. Upon completion of the reaction, gas chromatography was used to confirm that the palm kernel oil left was less than 1%, to carry out cooling.

Synthetic Example 4

The same reactor that was used in Synthetic Example 1 was charged with 214 g (1 mol) of methyl laurate and 91 g (1.02 mol) of 2-amino-2-methyl-1-propanol. The mixture was raised up to 85° C. with blowing nitrogen into the reactor and then 5 g of 28% sodium methylate was added thereto. Then, the mixture was kept for 3 hours. Upon completion of the reaction, gas chromatography was used to confirm that the methyl laurate left was less than 1%, to carry out cooling.

Next, a 1 l pressure reactor was charged with all the reaction product and the atmosphere in the reactor was replaced by nitrogen. Then, the temperature of the reaction product was raised and 44 g (MW: 44) of ethylene oxide was charged over 10 minutes when the temperature reached 100° C. After kept for 1 hour as it was, the resulting product was cooled to complete the reaction. The average addition mols of the ethylene oxide was 1.0.

Example 1

With regard to aqueous solutions obtained by compounding the fatty acid alkanolamides obtained in Synthetic Examples 1 to 4 and thickeners selected from the comparative compounds shown in Table 1 in a surfactant "sodium polyoxyethylene (average EO addition mols=2) lauryl ether sulfate" in the concentrations shown in Table 1, each viscosity was measured in the following condition. Also, the melting point of each thickener was measured by a capillary heating method. The results are shown in Table 1.

<Viscosity Measuring Condition>

Total concentration of a thickener and a surfactant: 20% by weight

Measuring pH: 7.0

Measuring temperature: 25° C.

Viscometer: B-type viscometer

TABLE 1

| | | Viscosity (mPa · s) | | | | Melting |
|---|---|---|---|---|---|---|
| | | Amount* (weight-%) | | | | point |
| | Thickener | 0 | 1 | 3 | 5 | (° C.) |
| Product of the invention | Fatty acid alkanolamide of Synthetic Example 1 | 8 | 36 | 1300 | 29000 | 24 |
| | Fatty acid alkanolamide of Synthetic Example 2 | 8 | 25 | 170 | 4500 | −5.5 |
| | Fatty acid alkanolamide of Synthetic Example 3 | 8 | 30 | 230 | 5600 | −6.8 |
| | Fatty acid alkanolamide of Synthetic Example 4 | 8 | 36 | 280 | 7200 | 22 |
| Comparative product | Lauric acid diethanolamide | 8 | 20 | 156 | 3600 | 40 |
| | Coconut fatty acid monoethanolamide | 8 | 35 | 1500 | 13000 | 70 |
| | Lauric acid monoethanolamide | 8 | 38 | 1800 | Cloud | 95 |

*Concentration of a thickener in an aqueous solution

What is claimed is:

1. A thickener comprising a fatty acid alkanolamide represented by formula (1):

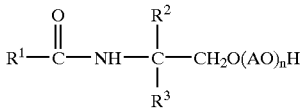

(1)

wherein $R^1$ represents a straight-chain or branched alkyl or alkenyl group, having 5 to 21 carbon atoms, which may be substituted with at least one hydroxyl group, $R^2$ and $R^3$ independently represent an alkyl group having 1 to 2 carbon atoms, AO represents an oxyalkylene group having 2 to 4 carbon atoms and n denotes a number of 0 to 10 in average.

2. The thickener according to claim 1, wherein $R^2$ and $R^3$ represent a methyl group.

3. A surfactant composition comprising the thickener as claimed in claim 1 or 2 and at least one surfactant.

4. The surfactant composition according to claim 3, wherein the surfactant is an anionic surfactant.

5. A method of thickening a surfactant, which comprises mixing a fatty acid alkanolamide as defined in claim 1 or 2 with the surfactant.

6. The thickener as claimed in claim 1, wherein the radical $R^1$ represents a straight-chain or branched alkyl or alkenyl group, having 7 to 17 carbon atoms, which maybe substituted with at least one hydroxyl group.

7. The thickener as claimed in claim 1, wherein the fatty acyl radical, $R^1CO$—, is obtained from a fatty acid which is selected from the group consisting of caprylic acid, capric acid, lauric acid, myristic acid, palmitic acid, stearic acid, oleic acid, ricinoleic acid, 12-hydroxystearic acid, isostearic acid, and mixtures thereof.

8. The thickener as claimed in claim 1, wherein the fatty acyl radical, $R^1CO$—, is obtained from lauric acid.

9. The thickener as claimed in claim 1, wherein the fatty acyl radical, $R^1CO$—, is obtained from coconut oil.

10. The thickener as claimed in claim 1, wherein the fatty acyl radical, $R^1CO$—, is obtained from palm kernel oil.

11. The thickener as claimed in claim 1, wherein $R^2$ and $R^3$ are both methyl radicals.

12. The thickener as claimed in claim 1, wherein AO is an oxoethylene.

13. The thickener as claimed in claim 1, wherein n denotes a number of 0 to 5 in average.

* * * * *